US009103106B1

(12) United States Patent
Williams

(10) Patent No.: US 9,103,106 B1
(45) Date of Patent: Aug. 11, 2015

(54) U-SHAPED CLOSET FLANGE

(71) Applicant: David Williams, Akron, IN (US)

(72) Inventor: David Williams, Akron, IN (US)

( * ) Notice: Subject to any disclaimer, the term of this patent is extended or adjusted under 35 U.S.C. 154(b) by 324 days.

(21) Appl. No.: 13/663,635

(22) Filed: Oct. 30, 2012

(51) Int. Cl.
*E03D 11/16* (2006.01)
*A47B 96/06* (2006.01)

(52) U.S. Cl.
CPC ..... *E03D 11/16* (2013.01); *A47B 96/061* (2013.01)

(58) Field of Classification Search
CPC ..... E03D 11/16; E03D 11/17; E03D 11/135; A47K 11/04
USPC ..... 4/239, 252.1, 252.4, 252.5, 478, 480, 4/667, 901; 285/56, 58; 248/223.41, 248/354.4, 354.5, 500, 903
See application file for complete search history.

(56) References Cited

U.S. PATENT DOCUMENTS 2,673,985 A 8/1954 Gay
3,680,154 A 8/1972 Stairs
4,052,759 A 10/1977 Hill
4,168,552 A * 9/1979 Austin ..... 4/667
4,648,139 A 3/1987 Stokes
4,886,302 A 12/1989 Forbes
6,553,585 B1 * 4/2003 Lundstrom ..... 4/667
D474,265 S 5/2003 Love
2008/0000018 A1 1/2008 Laher
2009/0235450 A1 * 9/2009 Nugent ..... 4/667

* cited by examiner

*Primary Examiner* — Paul R Durand
*Assistant Examiner* — Nicholas Ros

(57) ABSTRACT

The U-shaped closet flange is an auxiliary closet flange for use with a toilet that is seated onto an existing closet flange. The U-shaped closet flange fits around the rear base of a toilet from above the floor surface, and which improves the overall stability of the toilet by encircling the rear base of the toilet as well as across tops of opposing side lips of said base of said toilet. The U-shaped closet flange includes two generally parallel members that include grooves thereon to accommodate varying locales of bolts and bolt holes that extend up through the base of the toilet. The parallel members each include parallel base members that engage the floor surface, and interconnect with a cross member. Holes provided on the U-shaped closet flange enable screws to secure both the U-shaped closet flange and toilet in place to the surrounding floor.

6 Claims, 7 Drawing Sheets

PRIOR ART

U-SHAPED CLOSET FLANGE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of toilets and their respective closet flanges, more specifically, a uniquely designed and operable closet flange for use with a respective toilet.

Toilets are typically secured to the floor via a closet flange. Usually, a wax ring is inserted between the bottom of the toilet and the closet flange in order to form a watertight seal there between. Closet flanges usually include a couple of bolts that are directed upwardly and align with holes on the base of the toilet in order to bolt and secure said toilet thereon. However, traditional closet flanges only offer a limited amount of stability to the toilet. Depending upon the size of the end user, the toilet can tilt to either aide during repeated uses, and become unsealed with the closet flange, which is less than desirable.

A need exist for an auxiliary closet flange that secures the base of the toilet from around the rear of the base, and which includes means to secure said auxiliary closet flange to the adjacent floor. The device of the present application seeks to address this need by providing a U-shaped closet flange that attaches to and encircles a rear portion of the base of the toilet from above the floor surface, and which provides greater stability to the toilet when in use.

B. Discussion of the Prior Art

As a preliminary note, it should be stated that there is an ample amount of prior art that deals with closet flanges, generally speaking. As will be discussed below, no piece of prior art discloses a U-shaped closet flange that fits around the rear base as well as across tops of opposing side lips of said base of said toilet from above the floor surface, and which operates with a toilet that is seated onto an existing closet flange in order to further support said toilet in place; wherein the U-shaped closet flange is constructed of two parallel members that include grooves to accommodate varying locales of bolts and bolt holes that extend up through the base of the toilet; wherein the parallel members each include parallel base members that engage the floor surface, and interconnect with a cross member; wherein the parallel base members and the parallel members work to extend over top of the opposing side lips of the base of the toilet; wherein the parallel members include a plurality of holes to enable screws to secure both the U-shaped closet flange and toilet in place to the surrounding floor.

The Laher Patent Application Publication (U.S. Pub. No. 2008/0000018) discloses a bracket assembly for fixing a sink, a commode, a bidet, or a urinal bowl to the floor surface of a bathroom. However, the bracket assembly does not work with an existing toilet seated atop of an existing closet flange in order to provide increased stability from above the floor surface.

The Hill Patent (U.S. Pat. No. 4,052,759) discloses a floor-mounted anchor unit for toilets. However, the anchor unit does not fit around the rear base portion of the toilet as well as above a top surface of opposing side lips in order to further secure said toilet in place on the floor surface as well as to preserve the wax ring between the toilet and existing closet flange.

The Stairs Patent (U.S. Pat. No. 3,680,154) discloses a toilet bowl and an anchor plate for mounting a toilet bowl on the floor of a room. However, the anchor plate is not an auxiliary closet flange that fits around the rear base of the toilet as well as above the opposing side lips in order to further secure said toilet that is already seated to an existing closet flange.

The Stokes Patent (U.S. Pat. No. 4,648,139) discloses a mounting ring assembly for a toilet bowl. Again, the mounting ring does not work from above a floor surface and in conjunction with a toilet seated to an existing closet flange.

The Forbes Patent (U.S. Pat. No. 4,886,302) discloses a repair flange for anchoring a toilet to a floor. However, the repair flange is not an auxiliary closet flange that works with a toilet seated on an existing closet flange in order to further stabilize said toilet.

The Gay Patent (U.S. Pat. No. 2,673,985) discloses a basin-type floor flange for water closets. Again, the flange is sandwiched between the floor and the toilet, and is not an auxiliary flange that works with an existing toilet seated to an existing closet flange.

The Patent (U.S. Pat. No. Des. 474,265) illustrates an ornamental design for a spacer and shim assembly for elevating the water closet ring of a toilet bowl.

While the above-described devices fulfill their respective and particular objects and requirements, they do not describe a U-shaped closet flange that fits around the rear base as well as across tops of opposing side lips of said base of said toilet from above the floor surface, and which operates with a toilet that is seated onto an existing closet flange in order to further support said toilet in place; wherein the U-shaped closet flange is constructed of two parallel members that include grooves to accommodate varying locales of bolts and bolt holes that extend up through the base of the toilet; wherein the parallel members each include parallel base members that engage the floor surface, and interconnect with a cross member; wherein the parallel base members and the parallel members work to extend over top of the opposing side lips of the base of the toilet; wherein the parallel members include a plurality of holes to enable screws to secure both the U-shaped closet flange and toilet in place to the surrounding floor. In this regard, the U-shaped closet flange departs from the conventional concepts and designs of the prior art.

SUMMARY OF THE INVENTION

The U-shaped closet flange is an auxiliary closet flange for use with a toilet that is seated onto an existing closet flange. The U-shaped closet flange fits around the rear base of a toilet from above the floor surface, and which improves the overall stability of the toilet by encircling the rear base of the toilet as well as across tops of opposing side lips of said base of said toilet. The U-shaped closet flange includes two generally parallel members that include grooves thereon to accommodate varying locales of bolts and bolt holes that extend up through the base of the toilet. The parallel members each include parallel base members that engage the floor surface, and interconnect with a cross member. A plurality of holes provided on the U-shaped closet flange enable screws to secure both the U-shaped closet flange and toilet in place to the surrounding floor.

It is an object of the invention to provide an auxiliary closet flange that works with a traditional closet flange to provide increased support and stability to a toilet seated thereon.

A further object of the invention is to provide a U-shaped closet flange that engages the rear portion of the base of the toilet, and which supports said toilet to the ground surface.

An even further object of the invention is to provide a U-shaped closet flange that further covers the top surface of opposing side lips of the base in order to further secure said toilet to the floor surface.

Another object of the invention is to provide a plurality of grooves that accommodate different bole and bolt hole locales associated with different toilets.

Another object of the invention is to provide a U-shaped closet flange that attaches around the rear of the base of the toilet from above the floor surface, and which attaches to the floor surface via a plurality of screws.

These together with additional objects, features and advantages of the U-shaped closet flange will be readily apparent to those of ordinary skill in the art upon reading the following detailed description of presently preferred, but nonetheless illustrative, embodiments of the U-shaped closet flange when taken in conjunction with the accompanying drawings.

In this respect, before explaining the current embodiments of the U-shaped closet flange in detail, it is to be understood that the U-shaped closet flange is not limited in its applications to the details of construction and arrangements of the components set forth in the following description or illustration. Those skilled In the art will appreciate that the concept of this disclosure may be readily utilized as a basis for the design of other structures, methods, and systems for carrying out the several purposes of the U-shaped closet flange.

It is therefore important that the claims be regarded as including such equivalent construction insofar as they do not depart from the spirit and scope of the U-shaped closet flange. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
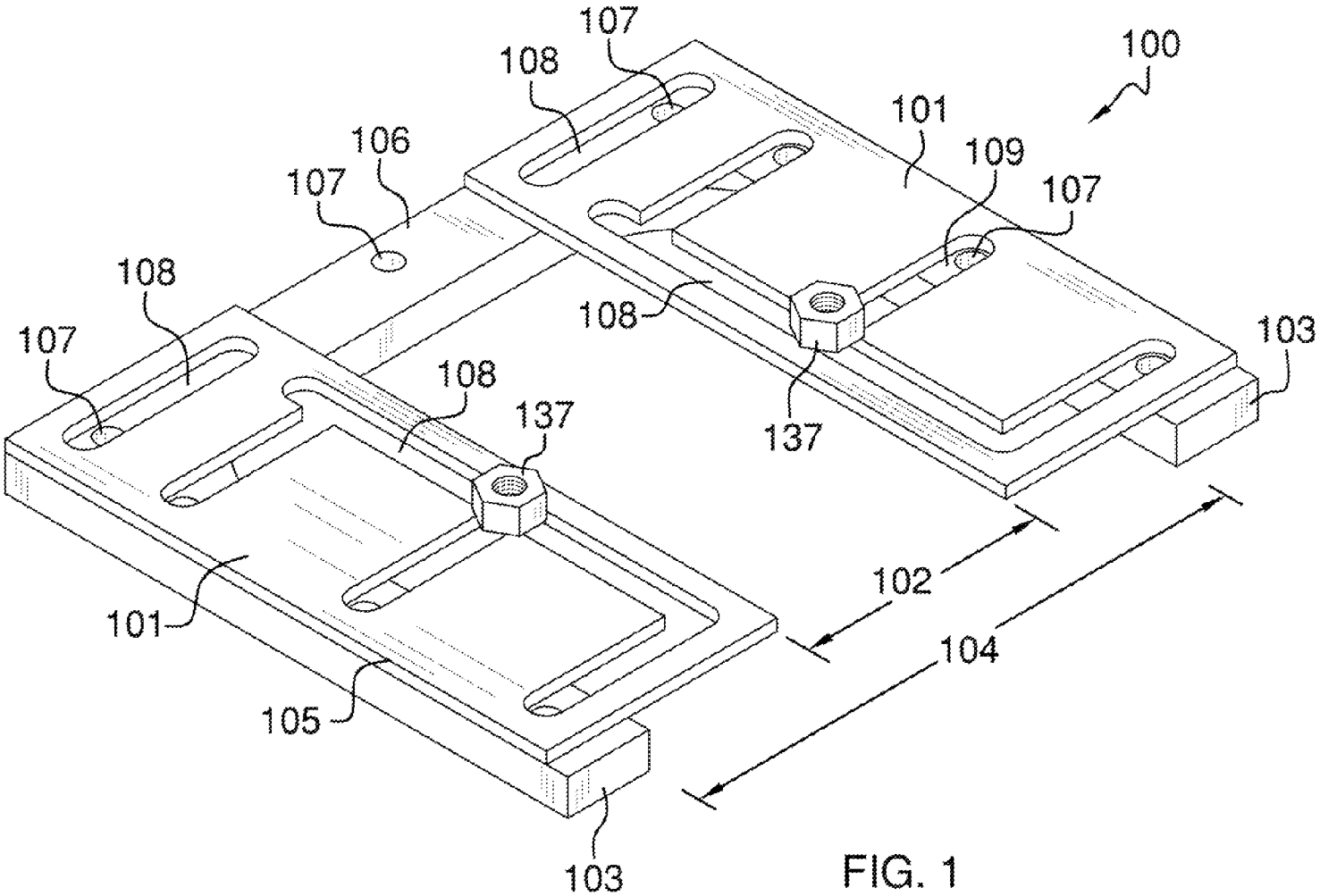
FIG. 1 illustrates a perspective view of the U-shaped closet flange by itself.
Figure 2:
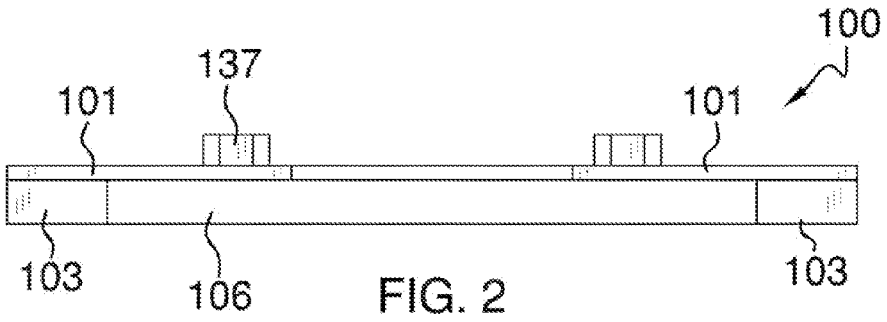
FIG. 2 illustrates a side view of the U-shaped closet flange by itself.

Detailed reference will now be made to the preferred embodiment of the present invention, examples of which are illustrated in FIGS. 1-8. A U-shaped closet flange 100 (hereinafter invention) includes two generally parallel members 101 that are separated from one another by a distance 102. The parallel members 101 each include a base parallel member 103 that are separated by a base distance 104. The base parallel members 103 are also parallel with one another, and align with an outer surface 105 of the parallel members 101.

Figure 3:
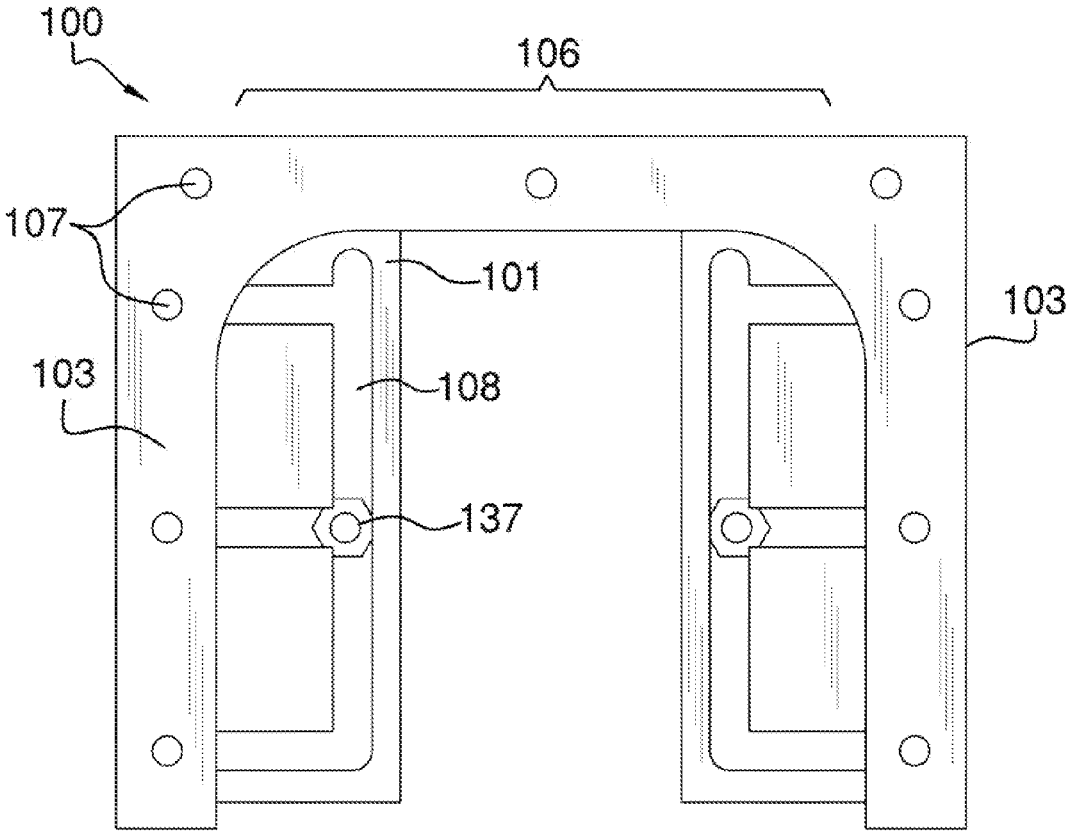
FIG. 3 illustrates a bottom view of the U-shaped closet flange by itself.

A cross member 106 connects to the base parallel members 103, and collectively form a U-shape (see FIG. 3). The base parallel members 103 and the cross member 106 include a plurality of holes 107 that are strategically placed in order to provide means of securing the invention 100 to a surrounding floor surface 140. The cross member 106, the base parallel members 103, and the parallel members 101 may be collectively made of the same material. However, the cross member 106 and the base parallel members 103 are made of the same material in that the components form a single object, which is secured to the parallel members 101. The invention 100 may be made of a material comprising a plastic, a wood, a metal, a carbon fiber composite, or a ceramic.

The parallel members 101 each include grooves 108 integrated into their design. The grooves 108 enable the invention 100 to secure itself to a base 130 of a toilet. Moreover, the grooves 108 enable different toilet shapes and sizes to work in connection with the invention 100. Also, the grooves 108 form a shoulder 109 atop of the holes 107 to enable a floor fastener 160 to secure the invention 100 to the floor surface 140. It shall be noted that the term floor fastener 160 is being loosely used to define a wood screw that has a fastener head 161 that rests against the shoulder 109 thereby securing the invention 100 to the floor surface.

Figure 4:
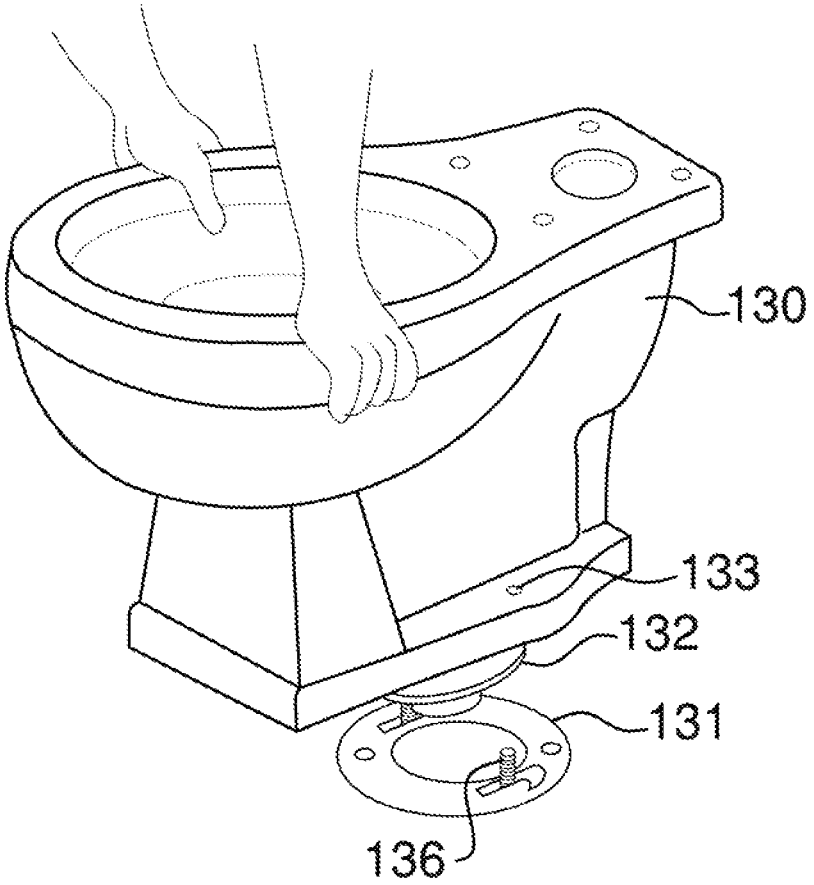
FIG. 4 illustrates a perspective view of prior art depicting a base of a toilet being seated to an existing closet flange.
Figure 5:
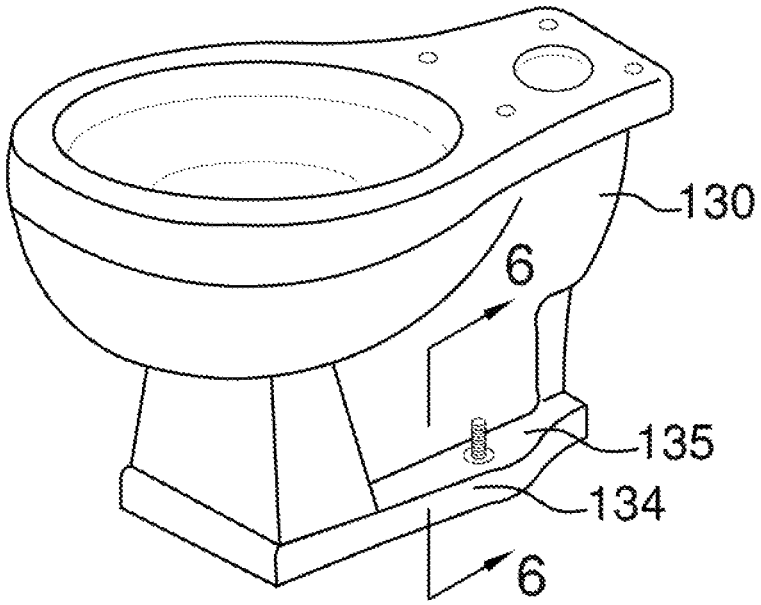
FIG. 5 illustrates a perspective view of the base of the toilet seated onto the closet flange with the wax ring positioned between the closet flange and the base of the toilet.
Figure 6:
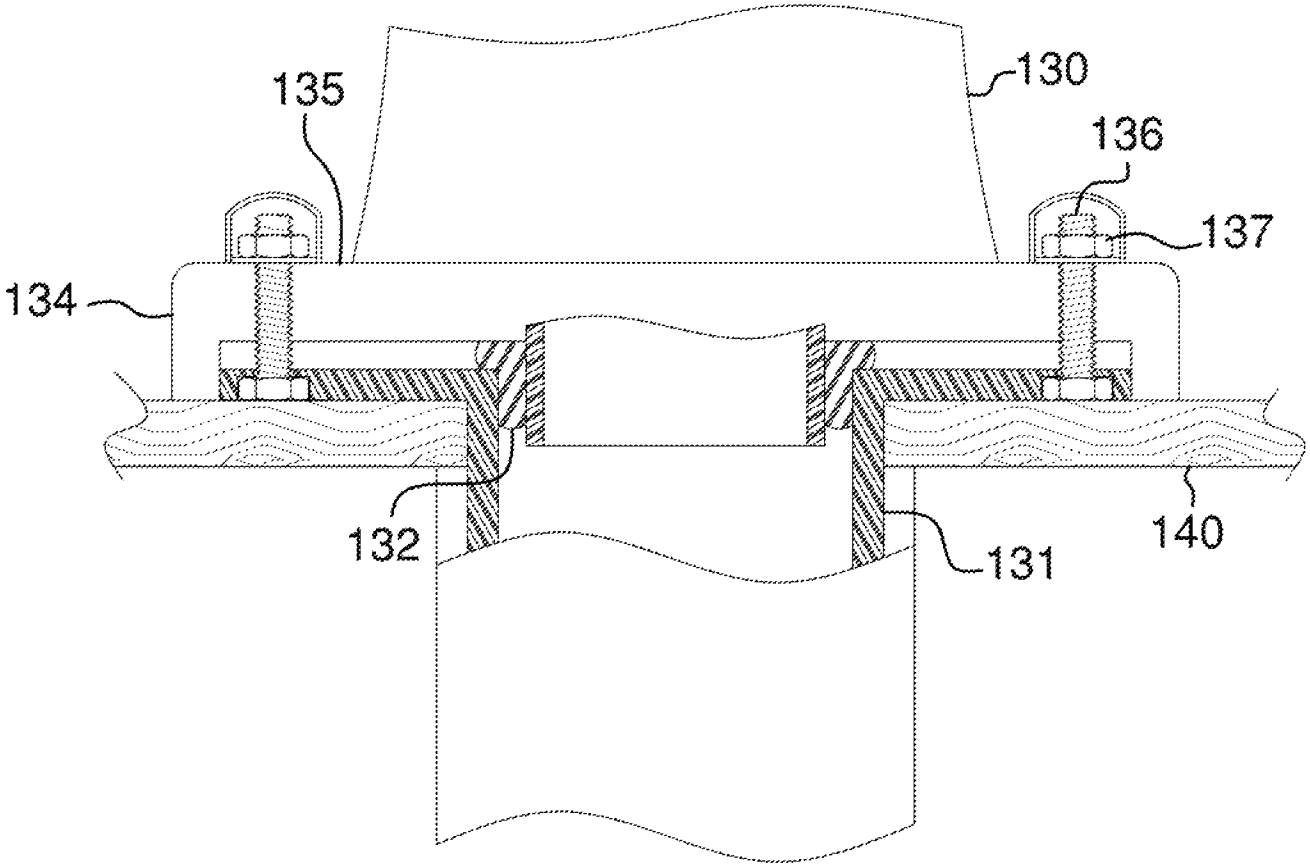
FIG. 6 illustrates a cross-sectional view of the base of the toilet along line 6-6 in FIG. 5.
Figure 7:
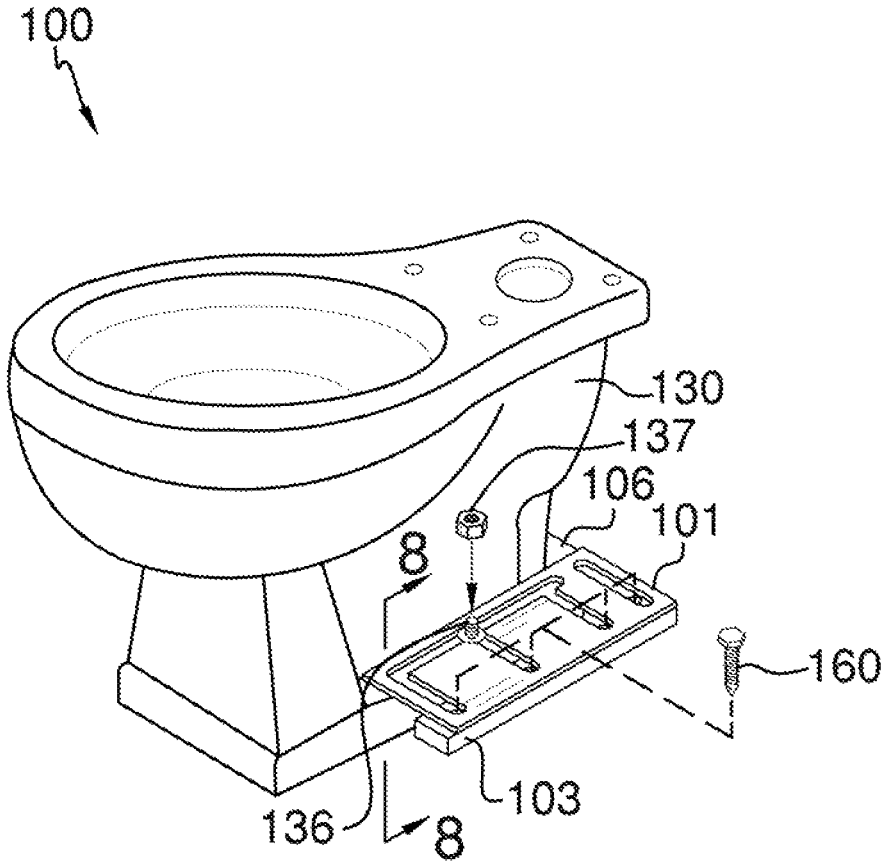
FIG. 7 illustrates a perspective view of the U-shaped closet flange positioned around the rear of the base of the toilet as well as over top of the side lips of the base.
Figure 8:
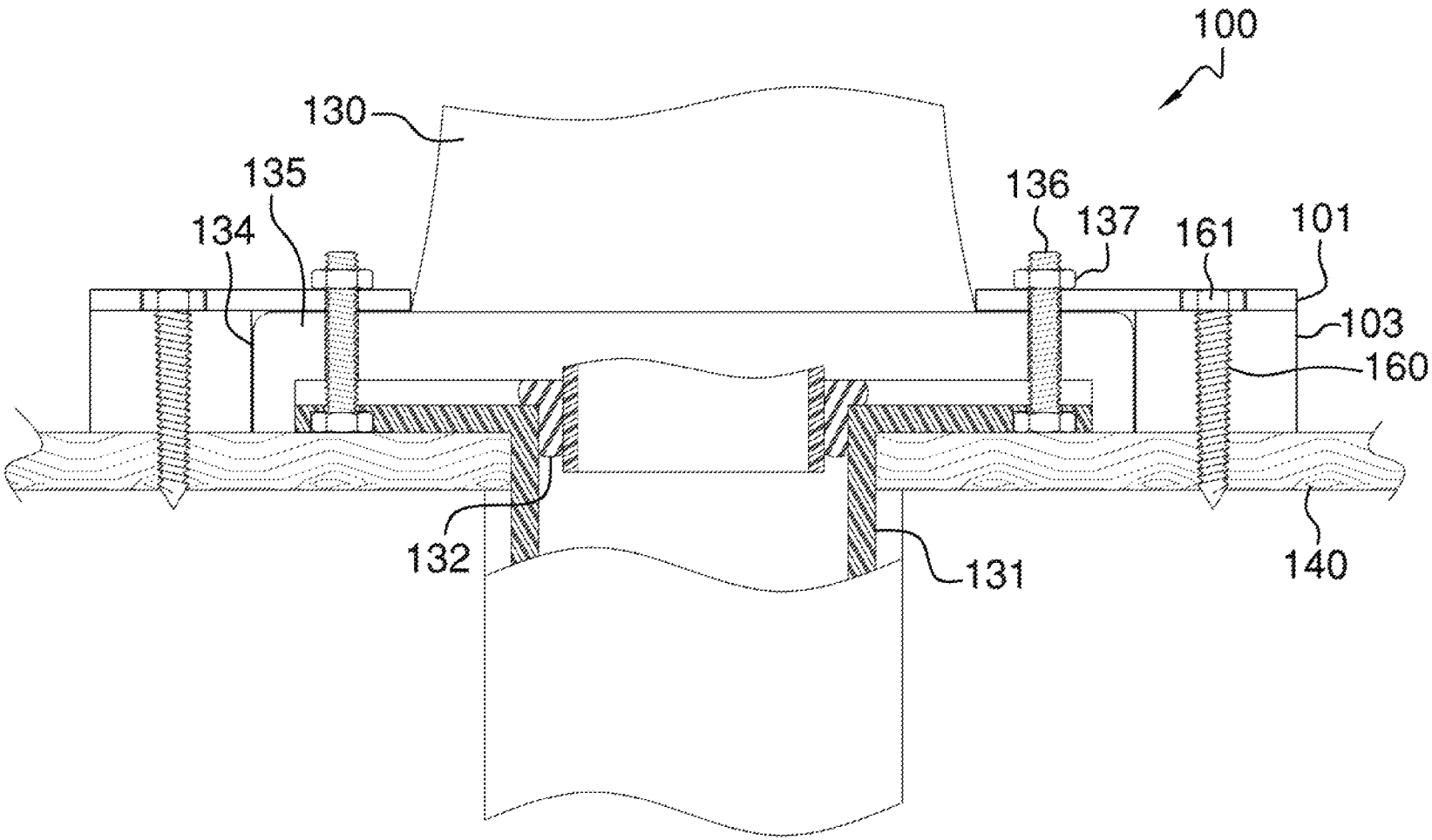
FIG. 8 illustrates a cross-sectional view of the U-shaped closet flange in use with a seated toilet along line 8-8 in FIG. 7.

Referring to FIGS. 4-6, the base 130 is seated to a closet flange 131 located on the floor surface 140. Moreover, a wax ring 132 is sandwiched between the base 130 and the closet flange 131 in order to form a watertight seal there between. The invention 100 is installed once the base 130 is seated to the closet flange 131 with the wax ring 132 sandwiched there between.

The base 130 of the toilet typically includes bolt holes 133 that are located on opposing side lips 134. The closet flange 131 usually includes two bolts 136 that are directed upwardly and extend through the bolt holes 133 in order to secure the base 130 of the toilet to the closet flange 131 via nuts 137. The invention 100 is designed to wrap around a rear portion of the base 130 of the toilet as well as to cover a top surface 135 of the opposing side lips 134. Once the invention 100 is correctly placed around the base 130, and over the opposing side lips 134 and ground surface 140, the fastening means 160 are used to secure the invention 100 to the ground surface 140. In referring to FIG. 8, it shall be noted that an inner surface 110 of the base parallel members 103 shall engage against sides of the opposing side lips 134 of the base 130 of the toilet 130.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A U-shaped closet flange that is used as an auxiliary closet flange to further stabilize an existing toilet that is seated to an existing closet flange;

wherein the U-shaped closet flange is positioned around a rear portion of a base of said existing toilet;

wherein the U-shaped closet flange covers over opposing side lips of said base of said existing toilet, and enables bolts to extend there through for use with a nut to secure both the U-shaped closet flange and said existing toilet to a surrounding floor;

wherein the U-shaped closet flange includes a fastening means and holes to secure said U-shaped closet flange to said surrounding floor;

wherein the U-shaped closet flange includes two generally parallel members that are separated from one another by a distance;

wherein the parallel members each include a base parallel member that are separated by a base distance;

wherein the base parallel members are also parallel with one another, and align with an outer surface of the parallel members;

wherein a cross member connects to the base parallel members, and collectively form said U-shape;

wherein the base parallel members and the cross member include said holes therein.

2. The U-shaped closet flange as described in claim 1 wherein the parallel members each include grooves that enable the bolts to extend there through as well as to form shoulders with the holes located on the base parallel members and the cross member.

3. A U-shaped closet flange comprising:

two generally parallel members;

wherein the U-shaped closet flange is used as an auxiliary closet flange to further stabilize an existing toilet that is seated to an existing closet flange;

wherein the U-shaped closet flange is positioned around a rear portion of a base of said existing toilet;

wherein the U-shaped closet flange covers over opposing side lips of said base of said existing toilet, and enables bolts to extend there through for use with a nut to secure both the U-shaped closet flange and said existing toilet to a surrounding floor;

wherein the U-shaped closet flange includes a fastening means and holes to secure said U-shaped closet flange to said surrounding floor;

wherein the parallel members each include a base parallel member that are separated by a base distance;

wherein a cross member connects to the base parallel members, and collectively form said U-shape;

wherein the base parallel members and the cross member include said holes therein.

4. The U-shaped closet flange as described in claim 3 wherein the two generally parallel members that are separated from one another by a distance; wherein the generally parallel members rest atop of the opposing side lips of the base of said existing toilet.

5. The U-shaped closet flange as described in claim 3 wherein the base parallel members are also parallel with one another, and align with an outer surface of the parallel members.

6. The U-shaped closet flange as described in claim 5 wherein the parallel members each include grooves that enable the bolts to extend there through as well as to form shoulders with the holes located on the base parallel members and the cross member.

* * * * *